United States Patent [19]

Humpolik et al.

[11] Patent Number: 4,593,539

[45] Date of Patent: Jun. 10, 1986

[54] EVAPORATOR, IN PARTICULAR FOR AUTOMOTIVE AIR CONDITIONING SYSTEMS

[75] Inventors: Bohumil Humpolik, Ludwigsburg; Hans-Joachim Ingelmann, Iggingen-Schoenhardt; Karl-Heinz Staffa, Stuttgart, all of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 719,462

[22] Filed: Apr. 3, 1985

[30] Foreign Application Priority Data

Apr. 13, 1984 [DE] Fed. Rep. of Germany ..... 3413931

[51] Int. Cl.[4] ..... F25B 39/02

[52] U.S. Cl. ..... 62/504; 62/525; 62/527

[58] Field of Search ..... 62/524, 527, 504, 525; 165/174

[56] References Cited

U.S. PATENT DOCUMENTS

| | | | |
|---|---|---|---|
| 1,684,083 | 9/1928 | Bloom | 62/525 |
| 2,013,521 | 9/1935 | McGehee | 62/504 |
| 2,063,380 | 12/1936 | Hoesel | 62/525 |
| 2,220,595 | 11/1938 | Andersen | 62/525 |
| 2,555,055 | 5/1951 | Ort | 62/525 |
| 3,563,055 | 2/1971 | Owens | 62/525 |
| 4,202,182 | 5/1980 | Kawashima et al. | 62/527 X |
| 4,524,823 | 6/1985 | Hummel et al. | 62/527 X |

*Primary Examiner*—Lloyd L. King

*Attorney, Agent, or Firm*—Schwartz, Jeffery, Schwaab, Mack, Blumenthal & Evans

[57] ABSTRACT

Disclosed is an evaporator, particularly for air conditioning installations in automotive vehicles, comprising an evaporator block including several evaporator tubes and coolant supply means. The coolant supply means comprise an expansion valve, a feed tube and a manifold from which the evaporator tubes extend. A calming line segment for the coolant is arranged within the manifold. A distributing space connected with the calming segment is located adjacent to the calming segment. Means are provided for deflecting the coolant between the calming segment and the distributor space.

16 Claims, 10 Drawing Figures

EVAPORATOR, IN PARTICULAR FOR AUTOMOTIVE AIR CONDITIONING SYSTEMS

BACKGROUND OF THE INVENTION

The present invention relates to an evaporator, particularly one for air conditioning installations in automotive vehicles. An evaporator of this general type is known, for example, from German Offenlegungsschrift No. 31 36 374.

Because evaporators are installed under conditions of restricted space, such as in the case of air conditioning devices of automotive vehicles, the problem arises that the expansion valve cannot be placed directly in front of the manifold. The connecting line between the expansion valve and the manifold is bent in sections, often with small bending radii, as a consequence of the restricted space.

The coolant separates into a liquid and a gaseous phase as the result of the distance between the expansion valve and the manifold and particularly because of the change in direction of the coolant due to the curvature of the supply line. Consequently, a quantitatively unequal division of the total volume over the different tube lengths results, and the tubes are variously impacted. This leads to certain of the evaporator tubes overheating in relation to the others, which has a negative effect on the control behavior of the installation and the performance of the evaporator.

In order to obtain a uniform flow of the coolant prior to its division into the individual tube lengths of the evaporator, it has already been proposed in German application No. P 33 27 179.8 to place a vortex element in the coolant flow directly in front of the manifold. This vortex element bursts the two phase flow consisting of coolant vapor and coolant liquid to achieve a turbulent mixing of the two phases. The inclusion of a vortex cell of this type has lead to very good results with respect to the uniform exposure of the evaporator tubes and thus to good evaporator performance. However, in spite of its small dimensions, a vortex cell requires a certain structural space directly in front of the manifold, which is not always available. Furthermore, there is an additional expense involved in the manufacture and installation of such a vortex cell.

SUMMARY OF THE INVENTION

It is therefore an object of the present invention to provide an improved evaporator of the above generic type.

It is a further object of the present invention to simply provide an arrangement for achieving a uniform distribution of the coolant over the evaporator tubes without the need for additional structural space.

It is also an object of the invention to provide such an arrangement which generates no additional production costs and limits the number of tube connections to a minimum.

In accomplishing the foregoing objects, there has been provided according to the present invention an evaporator, particularly for air conditioning installations in automotive vehicles, comprising an evaporator block including a plurality of evaporator tubes; and a coolant supply means including an expansion valve, a feed tube connected to the outlet of the expansion valve, and a manifold connected between the feed tube and the evaporator tubes to distribute coolant to the evaporator tubes, wherein the manifold comprises a calming line segment disposed within the manifold to provide for uniform mass flow of the coolant, a distributing chamber downstream of the calming line segment for distributing the flow of coolant from the calming line segment, and means for deflecting the flow of coolant, disposed between the calming line segment and the distributing chamber. Preferably, the calming line segment comprises a tubular body centrally located within the manifold, and the distributing chamber comprises an annular space surrounding the tubular body.

Further objects, features and advantages of the present invention will become apparent from the detailed description of preferred embodiments which follows, when considered together with the attached figures of drawing.

DETAILED DESCRIPTION OF PREFERRED EMBODIMENTS

Figure 1:
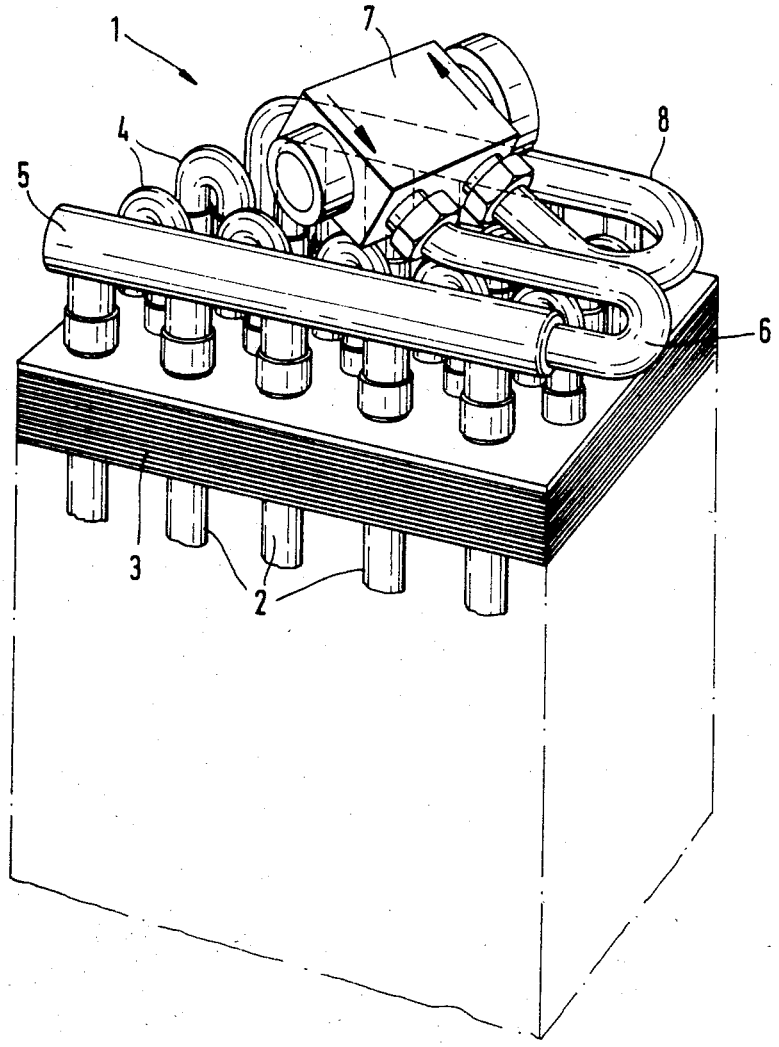
FIG. 1 is a perspective view of an evaporator according to the invention with an expansion valve and a manifold.

The present invention is based on the discovery that the mass flow of a coolant which has experienced an at least partial separation of the phases as the result of radial accelerations and mass inertia, may be converted into a flow suitable for uniform distribution by means of a calming line segment. The flow thus created is suitable because of a uniform loading of the flow cross section.

A preferred further development of the invention comprises providing a calming segment whose length is at least 7 times, preferably 10 to 12 times the diameter of the supply line. In order to obtain the simplest and most cost effective configuration, it is appropriate to design the calming segment as a tubular body arranged in the manifold tube and to provide a distributing chamber in the form of an annular space surrounding the calming line segment.

In order to assure the uniform loading of all of the evaporator tubes with the coolant following its diversion from the calming segment into the distributing chamber, it is proposed to form a number of channels in the annular space corresponding to the number of tube lengths. Each of the channels starts at the end of the calming segment or after a diverting means, respectively, and leads to a different tube length. The channels preferably have a helical configuration. This configuration is particularly preferable because of the gradual change in direction and for manufacturing reasons.

According to a further development of the invention, the distributing chamber comprises several separate channels initially extending parallel to the longitudinal axis of the manifold. All but one of the channels then extend in the circumferential direction of the manifold, so that the ends of all of the channels are arranged on an axis parallel to the manifold.

For arrangements in which the distributing chamber is formed by several individual channels, it is advantageous to provide a coolant distributor from which the individual channels extend at the end of the calming line segment. A flow distributor of this type is preferably in the form of a Venturi tube of the type which has been used in evaporators for a considerable length of time. The Venturi distributor is arranged in front of the means diverting the coolant in such a case.

A particularly simple configuration of the tubular body according to the invention comprises a design in which the tubular body extends almost to a plate closing the manifold. This free end of the tubular body is maintained in its centered position by radial, outwardly directed tabs supported on the inner wall of the manifold.

A particularly simple and cost effective configuration of the means to divert the flow of the coolant comprises designing the end of the manifold with a spherical shape. Another especially simple arrangement of the means to divert the coolant flow comprises closing the end of the calming line segment and manifold, and providing a plurality of radial orifices in the wall separating the calming segment from the manifold for the passage of the coolant. An embodiment of the calming line segment and the distributing channels, preferred because of its simple construction and easy installation, comprises forming channels between radial ribs integrated with the tubular body and abutting the wall of the manifold.

In FIG. 1, the symbol 1 designates an evaporator comprising essentially an evaporator block having a plurality of tubes 2, and fins 3 arranged transversely to the tubes. The tubes of one row are connected with the tubes 2 of another row by means of U-shaped bends 4, so that the interconnected tubes form a train of tubes from the first to the last rows. The tubes 2 of the first row of tubes are connected to a manifold 5 arranged over their respective tube ends. The manifold is closed at one end and connected with the expansion valve 7 by means of a feed line 6 at the other end. The ends of the tubes 2 of the last row of tubes open into a collector tube 8, from which the coolant is drawn off by a compressor, not shown. As seen in FIG. 1, for reasons of space, the expansion valve 7 cannot be arranged directly in front of the manifold 5. The expansion valve 7 is therefore placed at another location, above the evaporator block, for example. A feed tube 6 having a tight radius of curvature is therefore required to connect the expansion valve 7 with the manifold 5.

Figure 2:
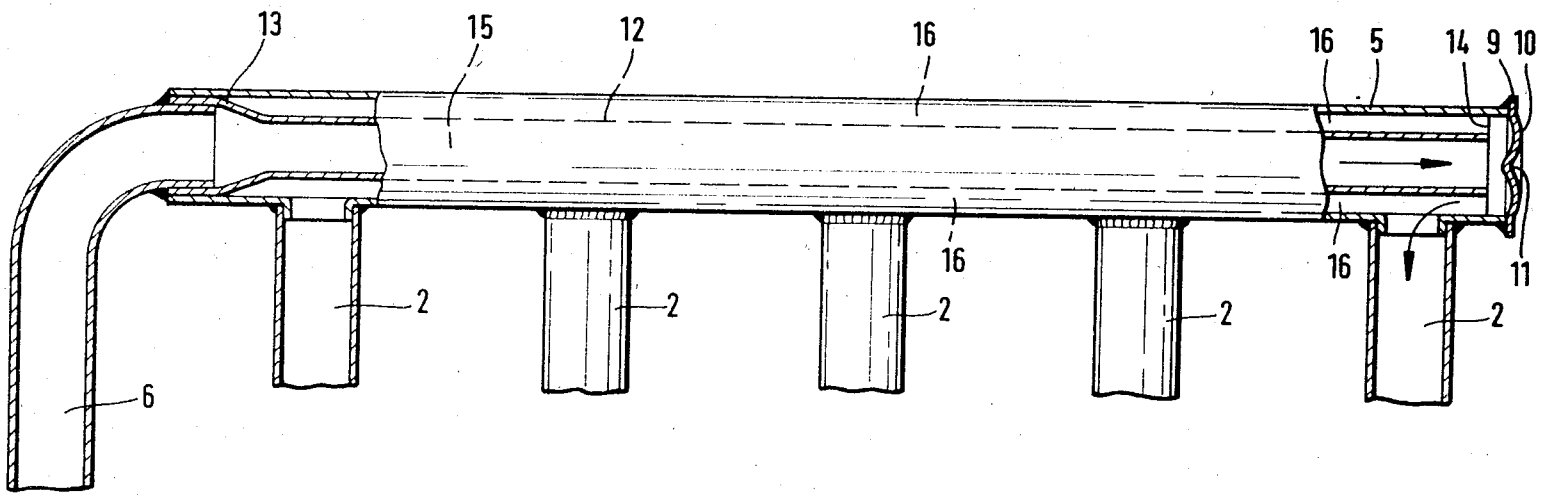
FIG. 2 is a plan view, partly in section, through a manifold with calming segments and a distributor chamber.

FIG. 2 shows a section through a manifold 5 according to the invention, with which the tubes 2 of the evaporator are connected. The manifold 5 is closed off at one end by means of a plate 9 which is designed to have a cone 11 pointing into the manifold 5, and an outwardly opening annular groove 10 surrounding the cone. A tubular body 12 is centrally arranged in the manifold 5. A feed line 6 is connected with and extends into a bell-shaped end 13 of the tubular body 12. The tubular body 12 extends uniformly almost to the plate 9. The tubular body 12 is supported on the inner wall of the manifold 5 at its end nearest plate 9 by means of a plurality of outwardly directed tabs 14. Orifices for the passage of the coolant are provided between the tabs 14. The tubular body 12 thus forms a calming line segment 15 extending over its entire length from the bell shaped end 13 to the end adjacent to the plate 9. An annular space 16, from which the evaporator tubes extend, is located between the tubular body 12 and the manifold 5. The coolant supplied by the feed tube 6 is conducted through the calming line segment 15 and diverted on the plate 9 into the annular space 16. The space 16 acts as a distributing chamber for distributing coolant to the parallel evaporator tubes 2.

Figure 3:
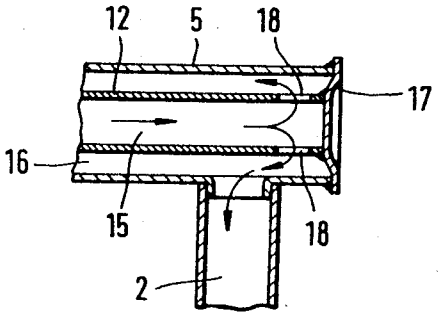
FIG. 3 is a sectional view of a variant of the embodiment of FIG. 2.

FIG. 3 shows a different embodiment of the end of the manifold 5, on the right side in FIG. 2. According to this embodiment, the tubular body 12 forming the calming line segment extends to and is fastened to an essentially flat plate 17 closing the manifold 5. The tabs 14 according to FIG. 2 are therefore no longer needed to support the tubular body 12. A plurality of orifices 18 are provided in the tubular body 12, in the vicinity of the plate 17, for allowing the coolant to pass from the calming line segment into the annular space 16 serving as the distributing chamber. The orifices are distributed evenly over the circumference of the tubular body 12.

Figure 4:
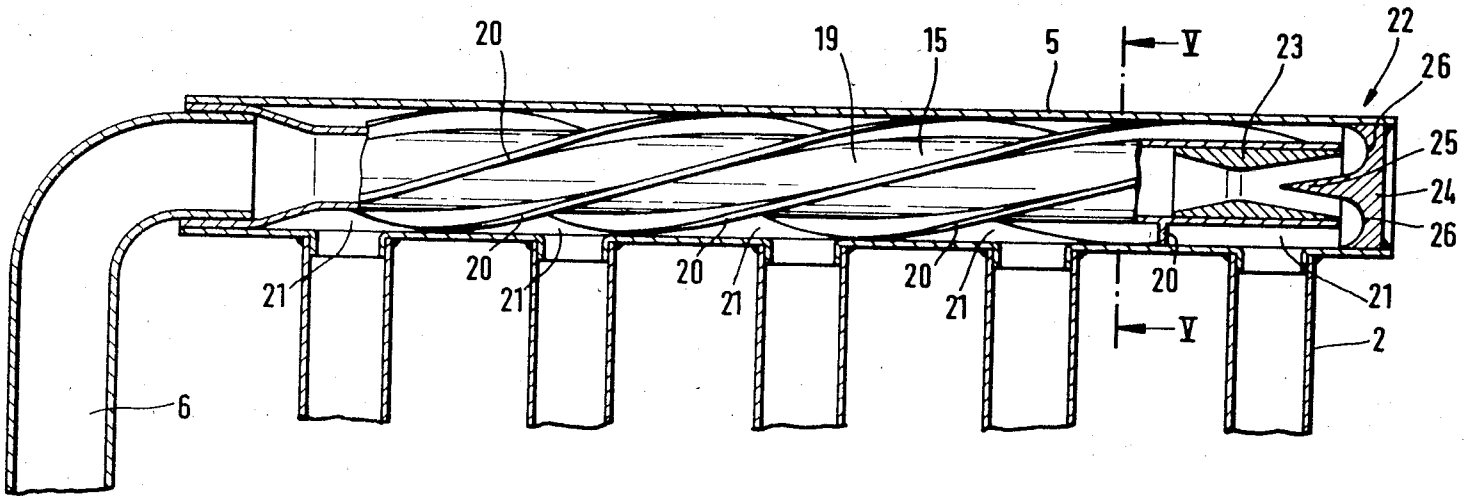
FIG. 4 is a view similar to FIG. 2 through a manifold with helical channels and a Venturi tube.

A section through another embodiment of the manifold 5 according to the invention is shown in FIG. 4. In this embodiment, a tubular body 19 with helical, radial ribs 2 on its outer surface 5 is disposed within the manifold 5. The ribs 20 extend to the wall of the manifold 5 and form a number of helical channels 21 corresponding to the number of ribs 20 between the tubular body 19 and the manifold 5. Each of channels 21 leads to one of the connections of the tubes 2. A flow distributor 22, formed within the tubular body 19 and having the configuration of a Venturi tube, is located at the end of the calming segment 15 pointing away from the feed tube 6. The distributor consists of two parts (23 and 25). The symbol 23 designates a sleeve pressed into the tubular body 19, which, when viewed in the direction of flow first comprises a tapering and then a conical expansion. A cone 25 extends into the conical expansion. The latter is a component of a disk 24 for closing off the manifold 5. A plurality of reversing channels 26 are provided in the disk adjacent to the cone 25. The channels extend past the end of the tubular body 19, and divert the coolant from the flow distributor 22 into the channels 21.

Figure 5:
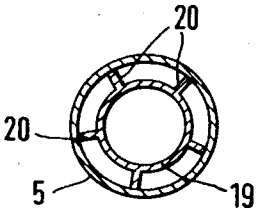
FIG. 5 is a sectional view along the line V—V in FIG. 4.

FIG. 5 shows a section along the line V—V in FIG. 4. It is seen in the figure that the tubular body 19 is arranged with 5 radial ribs 20, within the manifold 5. The ribs 20, which are integral with the tubular body 19, rest against the wall of the manifold 5. A channel 21 is always formed between two of the ribs 20.

Figure 6:
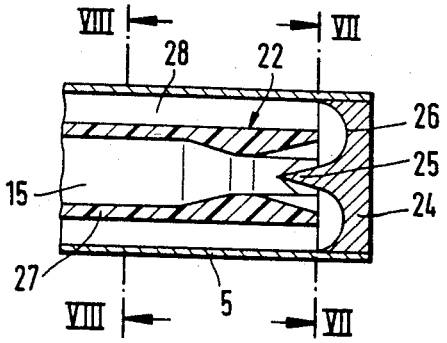
FIG. 6 is a sectional view of a variant of the embodiment of FIG. 4.

FIG. 6 shows a variant of the embodiment of FIG. 4 in which the manifold 5 is also closed off by a disk 24 with a center cone 25 and reversing channels 26. In this embodiment, a cylindrical body 27 is located in the manifold 5. The cylindrical body preferably comprises a synthetic plastic material and terminates in the vicinity of the disk 24. The reversing channels 26 overlap the end of the body 27. At the end of the calming segment 15, the body 27 comprises a cone tapering the flow cross section and thereafter an expanding cone. The aforementioned cone 25 of the disk 24 protrudes into the expanding cone, thereby forming the flow distributor 22. Several axially extending channels 28 are arranged on the outer surface of the cylindrical body 27. The channels lead to the connections of the evaporator tubes 2.

Figure 7:
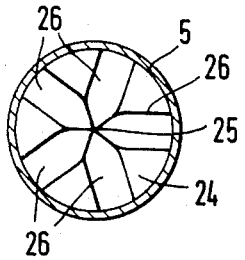
FIG. 7 is a sectional view along the line VII—VII in FIG. 6.

FIG. 7 shows a section along the line VII—VII of FIG. 6. The point of the cone 25 is disposed in the center of the disk 24 which is set into and closes off the manifold 5. The disk 24 has five reversing channels 26 in a star like configuration.

Figure 8:
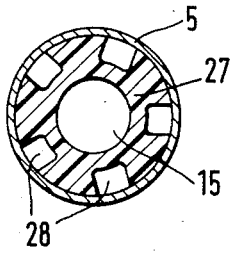
FIG. 8 is a sectional view along the line VIII—VIII in FIG. 6.

FIG. 8 shows a section along the line VIII—VIII of FIG. 6. It may be seen from the figure that a cylindrical body 27 is arranged in the manifold 5, and that the center of the cylindrical body comprises a central bore which forms the calming segment 15. Five channels 28 are arranged in a uniform distribution over the periphery of the outer surface of the cylindrical body 27; they are covered by the manifold 5.

Figure 9:
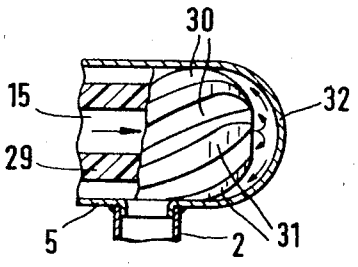
FIG. 9 is a view similar to FIG. 2 of a manifold with helical channels.

FIG. 9 shows an embodiment of the end of the manifold 5 facing away from the feed tube 6. A cylindrical body 29 with a central bore for functioning as the calming line segment is set in the manifold 5. On its outer surface, the body 29 comprises a plurality of helical channels 30. The channels are formed between the ribs 31 of body 29 and covered by the manifold 5. Each of the channels 30 leads to a connection of the evaporator tubes 2. The manifold tube 5 has a spherical end 32. The end of the body 29 is located at a distance from the spherical end 32, so that unimpaired passage of coolant from the calming segment into the distributor channels is possible.

Figure 10:
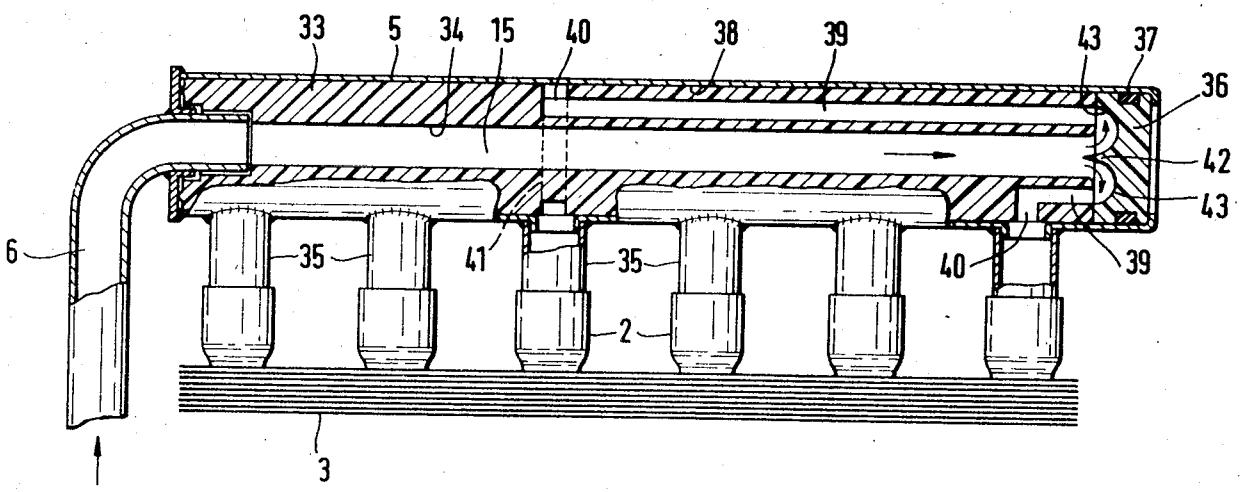
FIG. 10 is a sectional view through a manifold with internal distribution channels.

FIG. 10 shows the entire longitudinal section through a manifold 5 according to another embodiment of the present invention. The body 33 is disposed in the manifold and comprises a central bore 34 over its entire length. The bore serves as a calming segment 15 for coolant. At the end of the body 33 to the left in FIG. 10, the feed tube 6 opens into the bore 34. Six evenly-spaced tube fittings 35 are arranged on the manifold. The fittings are connected to the evaporator tubes 2 which extend transversely through the fins 3. The end of the manifold 5 facing away from the feed tube 6 is closed by a disk 36 provided with a gasket 37 on its external periphery. Six channels 39 extending in the longitudinal direction of the body, are arranged in the body 33 in a circular distribution. The channels are disposed at a radial distance from the bore 34 and the outer surface 38 of the body 33. An axial orifice 40 is located at the position of a connecting fitting in each case to connect the channels 39 with the outer surface 38. A plurality of channels 41 is provided for extending around the circumference. The channels open in the area of the connecting fittings 35. This arrangement of the channels 39, 40, 41 assures that each of the channels formed from the sections 39, 40, 41 opens at one of the connecting fittings 35. The fittings are located on an axis parallel to the manifold 5. A cone 42 is arranged on the side of the disk facing the body 33. The cone protrudes slightly into the center bore 34 and its outer surface passes into the reversing channels 43. The outer ends of the reversing channels coincide with the channels 39 of the body 33.

In the exemplary embodiments described above the coolant is conducted from the expansion valve through the feed tube 6 and into the calming line segment 15. As a result of the tight radii of curvature of the feed tube 6, the wet vapor mixture separates so that the coolant is present in at least two phases. Subsequently, a uniform distribution of the mass flow over the cross section of the calming line segment 15 is obtained, so that the distribution of the coolant over the individual tube lengths of the evaporator also takes place in individual streams of equal mass.

What is claimed is:

1. An evaporator for air conditioning installations in automotive vehicles, comprising:

an evaporator block including a plurality of evaporator tubes; and a coolant supply means including an expansion valve for producing a mixed phase gas-liquid coolant medium, a feed tube connected to the outlet of said expansion valve and having a configuration which produces at least some separation of the gas and liquid coolant phases, and a manifold connected between said feed tube and said evaporator tubes to distribute coolant to said evaporator tubes, wherein said manifold comprises means, including a calming line segment of sufficient length disposed within the manifold for providing uniform mass flow of the mixed phase coolant over the cross section of the calming line segment, a distributing chamber downstream of the calming line segment for distributing the flow of coolant from the calming line segment to said evaporate tubes, and means for deflecting the flow of coolant, disposed between the calming line segment and the distributing chamber.

2. An evaporator as claimed in claim 1, wherein the length of the calming segment is at least about 7 times the diameter of the feed tube.

3. An evaporator as claimed in claim 2, wherein the length of the calming segment is between about 10 and 12 times the diameter of the feed tube.

4. An evaporator as claimed in claim 1, wherein the calming line segment comprises a tubular body centrally located within the manifold, and wherein the distributing chamber comprises an annular space surrounding the tubular body.

5. An evaporator as claimed in claim 1, wherein the distributing chamber comprises a channel corresponding to each evaporator tube for directing coolant from said deflecting means to said tube evaporator tube.

6. An evaporator as claimed in claim 5, wherein each of said channels has a helical configuration.

7. An evaporator as claimed in claim 1, wherein the distributing chamber comprises a channel corresponding to each evaporator tube, wherein each of said channels extends from said deflecting means parallel to the longitudinal axis of said manifold, and wherein all but the shortest one of said channels extend around the circumference of said manifold to connect with its respective evaporator tube.

8. An evaporator as claimed in claim 5, further comprising flow distributor means for distributing the coolant individually to said channels, wherein the channels issue from said flow distributor.

9. An evaporator as claimed in claim 8, wherein said flow distributor means comprises a Venturi tube.

10. An evaporator as claimed in claim 4, wherein said manifold comprises a first end connected with said feed tube, a second end away from said feed tube, and an inner wall; and wherein said evaporator further comprises a plate for closing off the second end of said manifold, and a plurality of radially outwardly-directed tabs for supporting said tubular body on said inner wall near said plate.

11. An evaporator as claimed in claim 10, wherein said deflecting means comprise a cone connected to said plate and extending toward said first end of said manifold, and an annular groove surrounding the cone.

12. An evaporator as claimed in claim 1, wherein said deflecting means comprises a spherical end for said manifold away from said feed tube.

13. An evaporator as claimed in claim 4, further comprising a plate for closing off said tubular body away from said feed tube, wherein said deflecting means comprise a plurality of radial orifices in said tubular body substantially near said plate, and wherein said orifices connect the calming line segment with the annular space.

14. An evaporator as claimed in claim 5, wherein said deflecting means comprises a reversing channel corresponding to and connected with each channel.

15. An evaporator as claimed in claim 6, wherein said tubular body comprises integral ribs for abutting said manifold and for defining said channels.

16. An evaporator as claimed in claim 4, wherein said tubular body is closed along substantially its entire length.

* * * * *